United States Patent [19]

Kelso

[11] Patent Number: 4,771,270

[45] Date of Patent: Sep. 13, 1988

[54] TEMPERATURE SENSITIVE FIRE ALARM UNIT

[75] Inventor: James W. Kelso, Santa Monica, Calif.

[73] Assignee: Nathelle Victoria Woodward, Pacific Palisades, Calif. ; a part interest

[21] Appl. No.: 41,454

[22] Filed: Apr. 23, 1987

[51] Int. Cl.[4] ..... G08B 17/06

[52] U.S. Cl. ..... 340/590; 116/106; 169/23; 169/42

[58] Field of Search ..... 340/590; 75/230, 0.5 AC, 75/0.5 BC; 116/106; 122/504.1; 169/42, 23

[56] References Cited

U.S. PATENT DOCUMENTS 2,710,393 6/1955 Golberg ..... 340/590

*Primary Examiner*—Glen R. Swann, III

*Attorney, Agent, or Firm*—Keith D. Beecher

[57] ABSTRACT

A simple, compact and inexpensive battery powered fire alarm unit has a normally closed spring-loaded electrical contact which is held open by a cermet metal strip, or the like, which is constructed to melt and fail at a predetermined high temperature level indicative of a fire condition. When the strip fails, the contact closes and connects an electrically activated sounder across the battery.

2 Claims, 1 Drawing Sheet

TEMPERATURE SENSITIVE FIRE ALARM UNIT

BACKGROUND OF THE INVENTION

The fire alarm unit of the invention is advantageous in that it can be sold at a relatively low price, and a number of the units may be purchased and mounted in the various rooms of residences, hotels and offices. The alarm unit is battery operated and does not depend for its energy on the electrical mains which could fail during a fire.

As stated above, the alarm unit is held in its normally inactive state by a strip of cermet, or like material. Cermet is a group of composite materials consisting of an intimate mixture of ceramic and metallic components. Selected metallic and ceramic components may be used to provide a cermet which will melt and fail at a selected temperature of around, for example, 150° F., which is indicative of a fire condition. Representative cermets are as follows:

| | Representative cermets | |
|---|---|---|
| Class | Ceramic | Metal addition |
| Oxides | $Al_2O_3$ | Al, Be, Co, Co—Cr, Fe, stainless steel |
| | $Cr_2O_3$ | Cr |
| | MgO | Al, Be, Co, Fe, Mg |
| | $SiO_2$ | Cr, Si |
| | $ZrO_2$ | Zr |
| | $UO_2$ | Zr, Al, stainless steel |
| Carbides | SiC | Ag, Si, Co, Cr |
| | TiC | Mo, W, Fe, Ni, Co, Inconel, Hasielloy, stainless steel, Vitallium |
| | WC | Co |
| | $Cr_3C_2$ | Ni, Si |
| Borides | $Cr_3B_2$ | Ni |
| | $TiB_2$ | Fe, Ni, Co |
| | $ZrB_2$ | Ni |
| Silicides | $MoSi_2$ | Ni, Co, Pt, Fe, Cr |
| Nitrides | TiN | Ni |

A selection may be made from the above list for the desired temperature characteristics for application to the fire alarm of the present invention.

DETAILED DESCRIPTION OF THE ILLUSTRATED EMBODIMENT

Figures 1, 2:
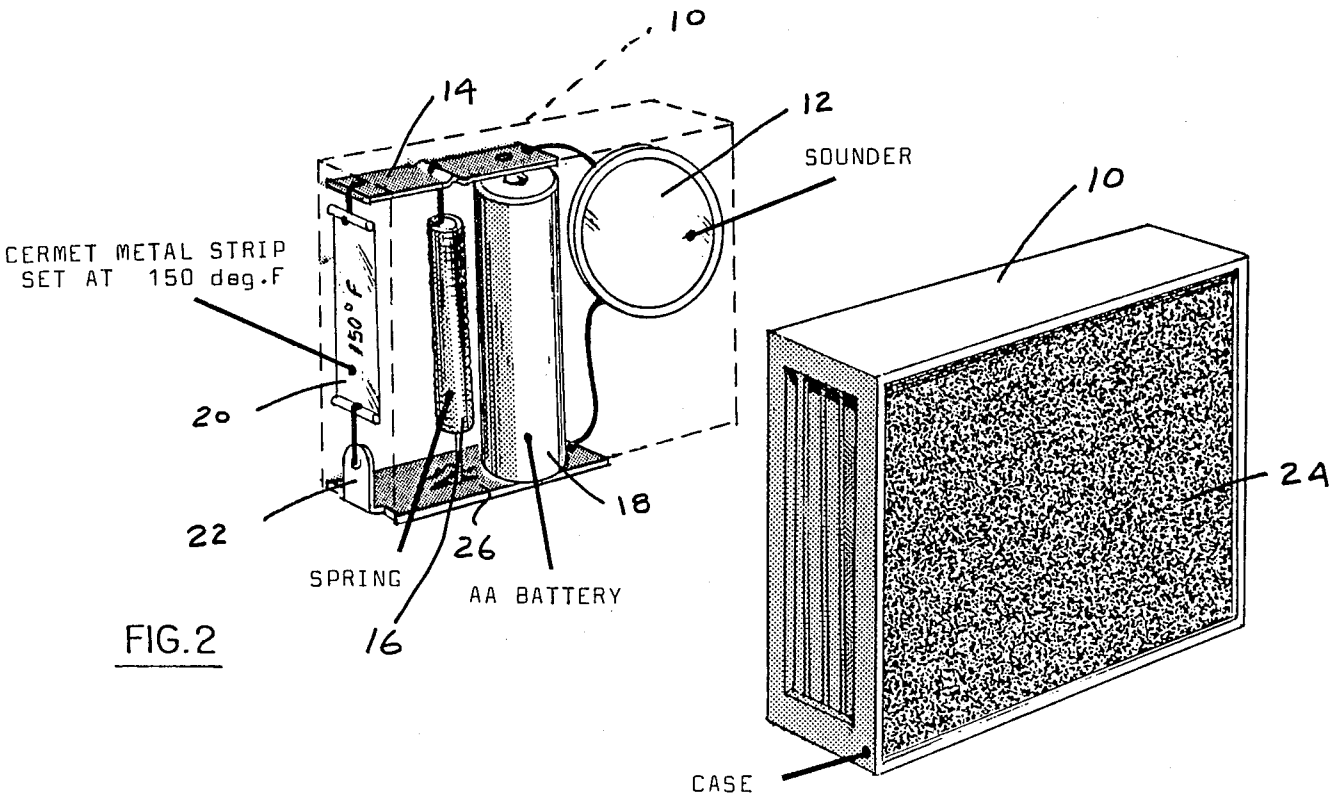
FIG. 1 is a perspective view of a unit representing one embodiment of the invention, and specifically of the case in which the internal components of the unit are mounted.
FIG. 2 is a perspective representation of the internal components of one embodiment of the invention.

As shown in FIG. 1, the alarm unit may comprise a case 10 which, for example, may have a fabric wall 24. The alarm unit is relatively compact and light, and it may be easily mounted in a room of a dwelling or office, as mentioned above.

Mounted within the case 10 is a sounder 12, which may take the form of any electrically activated transducer which emits a high intensity audible signal when energized. A battery 18 is mounted in an upright position within the case.

A rigid contact 14 is pivotally mounted in the case 10 in position to contact the positive terminal of the battery 18 when it is turned in a clockwise direction about its pivot axis. One lead to sounder 12 is connected to contact 14.

An electrically conductive metal insert 26 is mounted on the bottom of case 10 in contact with the negative terminal of battery 18, and the other lead to sounder 12 is connected to the insert. A spring 16 has one end physically attached to insert 26 but electrically insulated from the insert, and the spring has its other end attached to the contact 14. The spring serves to bias the contact into engagement with the positive terminal of battery 18 to activate sounder 12.

The contact 14 is normally held displaced from the positive terminal of battery 18 by a cermet metal strip 20 which is attached at one end to contact 14, and at its other end to a tab 22 which is integral with metal insert 26.

Cermet metal strip 20, as stated, normally holds the contact 14 displaced from the positive terminal of battery 18. However, should the ambient temperature rise above 150° F., for example, the strip will fail and release the contact 14. Spring 16 will then turn the contact about its pivot axis and cause it to engage the positive terminal of battery 18 and activate sounder 12.

The invention provides, therefore, an extremely simple alarm unit which is battery powered, which may be mounted easily at various locations within a residence, hotel or office.

While a particular embodiment of the invention has been shown and described, modifications may be made. It is intended in the claims to cover all modifications which come within the true spirit and scope of the invention.

I claim:

1. A temperature sensitive fire alarm unit comprising: a case; a battery mounted in said case; an electrical contact pivotally mounted within said case and positioned selectively to engage one terminal of said battery; an electrically energized alarm transducer mounted in said case and electrically connected to a second terminal of said battery and to said contact to be activated when said contact engages said one terminal of said battery; resilient means mounted in said case and physically connected to said contact for biasing said contact into engagement with said battery; and a temperature sensitive element physically connected to said contact to hold said contact displaced from said battery until the ambient temperature exceeds a predetermined threshold at which said temperature sensitive element melts and fails.

2. The temperature sensitive fire alarm unit defined in claim 1, in which said temperature sensitive element is formed of a selected cermet metal material.

* * * * *